United States Patent [19]

Miller et al.

[11] Patent Number: 4,510,041

[45] Date of Patent: Apr. 9, 1985

[54] METHOD FOR MINIMIZING FOULING OF HEAT EXCHANGER

[75] Inventors: Richard F. Miller, Humble; Michael P. Nicholson, Houston, both of Tex.

[73] Assignee: Atlantic Richfield Company, Los Angeles, Calif.

[21] Appl. No.: 639,893

[22] Filed: Aug. 10, 1984

[51] Int. Cl.[3] ..... C10G 9/16

[52] U.S. Cl. ..... 208/48 AA; 252/47; 252/47.5; 585/950

[58] Field of Search ..... 208/48 AA; 252/47, 47.5; 585/950

[56] References Cited

U.S. PATENT DOCUMENTS

| | | | |
|---|---|---|---|
| Re. 26,330 | 1/1968 | Colfer | 208/48 AA |
| 2,469,469 | 5/1949 | Kluge et al. | 208/48 AA |
| 2,560,044 | 7/1951 | Albert | 208/48 AA |
| 3,366,702 | 1/1968 | Moriarty | 208/48 AA |
| 3,539,515 | 11/1970 | McCabe | 252/47 |
| 3,556,983 | 1/1971 | Kronig et al. | 208/48 AA |
| 3,557,232 | 1/1971 | Starnes, Jr. | 208/48 AA |
| 3,756,943 | 9/1973 | Hopkins et al. | 208/48 AA |
| 4,465,881 | 8/1984 | Miller et al. | 585/4 |

*Primary Examiner*—Delbert E. Gantz
*Assistant Examiner*—Cynthia A. Prezlock
*Attorney, Agent, or Firm*—C. R. Reap

[57] ABSTRACT

Hydrocarbon processing equipment is protected against fouling during the processing of hydrocarbons at elevated temperatures by adding to the equipment small amounts of at least one N,N'-dimer of phenothiazine or a substituted phenothiazine and at least one mono- or ditertiary alkylphenol.

5 Claims, No Drawings

METHOD FOR MINIMIZING FOULING OF HEAT EXCHANGER

FIELD OF INVENTION

This invention relates to antifoulants and to a method of inhibiting fouling in petroleum or petroleum derivative processing equipment by injecting an antifoulant composition into a feed stream of the material being processed.

RELATED CASES

U.S. application Ser. No. 530,443, filed 9/8/83, relates to the use of mixtures of N,N'-dimers of phenothiazine and tertiary alkylphenols to prevent undesired polymerization of vinyl aromatic compounds.

BACKGROUND

Fouling of heat transfer surfaces of petroleum processing equipment occurs continuously during the period when petroleum or its derivatives are being processed in the equipment. The fouling is caused by the gradual buildup of a layer of high molecular weight polymeric material resulting from the thermal polymerization of unsaturated materials which are present in the petroleum. As time goes by, fouling continues with the attendant loss of heat transfer until finally the point is reached where it becomes necessary to take the equipment out of service for cleaning. Cleaning is expensive and time consuming; consequently, methods of preventing fouling, or at least significantly reducing the rate of fouling, are constantly being sought.

The most economical method of reducing the fouling rate in process heat transfer equipment is to add chemicals which inhibit fouling, called "antifoulants", to the feed stream being processed. Among the more interesting classes of chemical compounds which exhibit antifoulant activity are the phenothiazines. Their use to inhibit polymerization has been described in several patents.

PRIOR ART

U.S. Pat. Nos. 4,061,545 and 4,177,110 issued to Watson, disclose the use of a combination of tertiarybutylcatechol and phenothiazine as a polymerization inhibitor system for vinyl aromatic compounds. U.S. Pat. No. 3,539,515, issued to McCabe, discloses the use of phenothiazine dehydrocondensates as antioxidants for lubricating oils. The phenothiazine dehydrocondensates are prepared by reacting phenothiazine or a substituted phenothiazine with an organic peroxide.

It has now been discovered that mixtures of N,N'-dimers of phenothiazine and mono- and/or dialkylphenols provide outstanding antifoulant protection for petroleum and petroleum derivative processing equipment. Thus, because of the synergistic effect of these mixtures it is now possible to provide unexpectedly superior antifouling protection with the same total equivalent weight of N,N'-dimers of phenothiazine and mono- and/or dialkylphenols mixtures than can be obtained by the use of members of either of these groups of compounds by themselves.

Accordingly, it is an object of the invention to present a method of enhancing the antifouling protection of petroleum processing equipment. This and other objects of the invention are set forth in the following description and examples of the invention.

SUMMARY OF THE INVENTION

The improved antifoulant compositions used in the invention are comprised of mixtures of at least one N,N'-dimer of phenothiazine or a substituted phenothiazine and one or more mono- or dialkylphenols, each alkyl group of which has 1 to 20 carbon atoms. In a preferred embodiment of the invention the antifoulant composition is dissolved in an organic solvent and the resulting solution is continuously injected into a stream of petroleum at a point which is upstream from the equipment which is to be protected.

DETAILED DESCRIPTION OF THE INVENTION

The N,N'-dimers of phenothiazine or substituted phenothiazine most useful in the invention have the structural formula

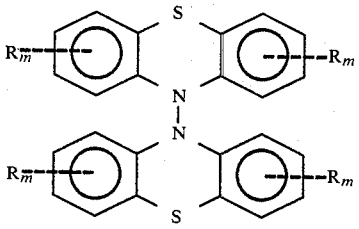

wherein m is an integer of 0 to 4, i.e. there may be from 0 to 16 R substituents on each molecule of the dimer, and some or all of the R's may be identical or all of the R's may be different. In the preferred embodiment the m's are integers having values of 0, 1 or 2. Each R may be a halogen atom or an unsubstituted or a halogen-substituted alkyl group having 1 to 20 and preferably 1 to 6 alkyl carbon atoms.

When all of the m's in the above structural formula are 0, the compound is the N,N' dimer of phenothiazine. This is the preferred dimer for use in of the invention since unsubstituted phenothiazine is less expensive as a starting material than the substituted phenothiazines. In an alternate embodiment the m's may be integers of 1 to 4, in which case the compound is a dimer of an alkyl-substituted or haloalkyl-substituted derivative of phenothiazine. Typical hydrocarbon alkyl substituents include methyl, ethyl, isopropyl, butyl, hexyldecyl, hexadecyl, etc. groups. There may be up to 4 such substituents on each benzene ring portion of the dimer. Since the dimer contains 4 benzene nuclei there may be up to 16 identical or different substituents. If all of the phenothiazine component starting material is phenothiazine or a single derivative of phenothiazine, the dimer is composed of two identical moieties. However, if the phenothiazine component starting material is composed of two or more different phenothiazine derivatives a mixture of products would result some of which could have 16 different substituents if the monomeric starting materials had all dissimilar substituents.

Typical phenothiazine dimers are 10,10'diphenothiazine; 1,1'-dimethyl-10,10'diphenothiazine; 2,6,2',6'-tetramethyl-10,10'-diphenothiazine; 2,2'-dimethyl-8,8'-dipropyl-10,10'diphenothiazine; 3,4'-dimethyl,6,7-'dihexyl-10,10'diphenothiazine; 2,2'-dichloro-10,10'-diphenothiazine; 3,3',7,7'-tetrabromo-10,10'-diphenothiazine; 4,4'-bis(2-chloroethyl)-10,10'-diphenothiazine; 3,3',6,6'-tetrakis(4-flourobutyl)-10,10'-diphenothiazine;

1,1',2,2',3,3',4,4',6,6',7,7',8,8',9,9'-hexadecylmethyl-10,10'-diphenothiazine; etc. From the standpoint of preparation, cost and utility, the preferred phenothiazine dimers are phenothiazine dimer and the alkyl-substituted phenothiazine dimers up to two substituents on each benzene nucleus, each substituent having 1 to 4 carbon atoms in each alkyl group. Examples of preferred substituted phenothiazine dimers are 1,1'-dimethyl-10,10'-phenothiazine, 2,2'-dimethyl-4,4'-diethyl-10,10'-diphenothiazine; 2,2',6,6'-tetramethyl-3,3'-diethyl-10,10'-diphenothiazine, etc.

The term "phenothiazine component" as used herein represents phenothiazine or any of the substituted phenothiazines in the above definition.

Phenothiazine and some hydrocarbon-substituted phenothiazines are available commercially. Others may be prepared by well-known techniques, such as alkylation. The preparation of the phenothiazine component forms no part of the present invention.

The phenothiazine dimers used in the invention are prepared by heating the phenothiazine component in the presence of an organic peroxide. The optimum reaction temperature employed will vary depending upon the particular phenothiazine compound used as the starting material and the particular organic peroxide used. In general, temperatures in the range of about 25° to 300° C. are effective to produce the desired result.

Any of the common organic peroxides can be used to effect the dimerization. The peroxide chosen will depend upon the desired reaction temperature. Typical organic peroxides include benzoyl peroxide, lauroyl peroxide, ditertiary-butyl peroxide, tertiary-butyl hydroperoxide, tertiary-butyl peroctoate, acetyl peroxide, etc.

The amount of peroxide present in the reactor relative to the amount of phenothiazine component in the reactor will determine the rate of reaction. Usually it is preferred to add the peroxide to the reactor containing the charge of phenothiazine component at a controlled rate to maintain the reaction speed at the desired rate. The amount of peroxide in the reactor is usually maintained in the range of about 1 to 50 mole percent and preferably in the range of about 5 to 25 mole percent, based on the total number of moles of phenothiazine component present in the reactor.

The dimers can be prepared by heating the phenothiazine component and organic peroxide directly, but since the phenothiazine component and many organic peroxides are solid, it is usually preferable to carry out the reaction in the presence of a solvent or diluent. Typical diluents include the lower alkanes; petroleum distillate; kerosene; ketones, such as methyl ethyl ketone; aldehydes, such as benzaldehyde, etc. Ideally the solvent or diluent is a substance which will not interfere with the intended end use of the product so that there will be no need to recover the dimer from the solvent or diluent prior to the end use. When the reaction is carried out in the presence of a solvent or a diluent, the solvent or diluent is generally present in amounts of about 70 to 97%, based on the total weight of components in the reaction mixture.

In a typical procedure for preparing the dimers used in the invention the phenothiazine component and solvent or diluent are charged to a suitable reactor. The desired amount of organic peroxide is then charged to the reactor and the reactor contents are heated to the reaction temperature. If desired, the reaction may be carried out under a nitrogen blanket. As the peroxide is consumed additional peroxide is added to the reactor, either continuously or incrementally, at a rate to control the progress of the reaction. Since the reaction is exothermic it may be necessary to cool the reactor during the course of the reaction. It is usually complete in about 2 to 24 hours, depending, of course, on the reaction conditions. Excess peroxide may be added to the reactor to ensure that all of the phenothiazine component is reacted. Upon completion of the reaction, the product may be recovered from the solvent or used as is.

The mono- and dialkyl-substituted phenols useful in the invention have the structural formula

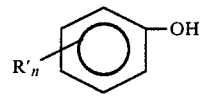

wherein R' is an alkyl group having 1 to 20 and preferably 4 to 12 carbon atoms and n is an integer having a value of 1 or 2. The preferred alkyl substituents are the tertiary alkyl groups.

Examples of mono- and dialkyl-substituted phenols useful in the invention are 2-methylphenol; 3-methylphenol; 2-ethylphenol; 4-t-butylphenol; 2-t-octylphenol; 4-dodecylphenol; 3-t-hexadecylphenol; 4-eicosylphenol; 2,4-dimethylphenol; 2,6-dimethylphenol; 2,4-di-t-butylphenol; 3,4-di-t-butylphenol; 3,5-di-t-butylphenol; 2,3-di-t-hexylphenol; 2,4-dodecylphenol; 2,6-di-t-dodecylphenol; 2,5-di-t-hexadecylphenol; 2,6-dieicosylphenol; 2-methyl-4-t-butylphenol; 2-hexyl-6-t-butylphenol, etc. Examples of preferred mono- and dialkylphenols include 2-methylphenol; 4-t-butylphenol; 2,4-di-t-butylphenol; 2,6-di-t-butylphenol; 2,4-di-octylphenol; 2,6-di-t-dodecylphenol; 3,5-dihexylphenol; etc.

In some cases it may be desirable to use mixtures of one or more mono- and/or dialkylphenols. Such mixtures are also within the scope of the invention.

Some mono- and dialkylphenols, such as di-t-butylphenol, are available commercially. Those mono- and dialkylphenols which are not commercially available may be prepared by any of the well known techniques. The preparation of these compounds forms no part of the present invention.

The relative concentrations of the N,N' dimer of the phenothiazine component and mono- and/or dialkylphenol used in the invention are generally in the range of about 10 to 90 weight percent of the N,N' dimer of the phenothiazine component and 90 to 10 weight percent total mono- and/or dialkylphenol, based on the total combined weight of these components. In preferred embodiments the concentrations generally fall in the range of about 25 to 75 weight percent of the N,N' dimer of the phenothiazine component and 75–25% total alkylphenol, based on the total combined weight of these components.

The antifoulant systems of the invention are particularly well suited for protecting the reboiler sections of a distillation column during distillation of vinyl aromatic monomers because of the high boiling point of the inhibitor compounds in the system. The antifoulant system may be used at temperatures up to about 400° C. or higher at atmospheric pressure. Since the boiling point of various members of each of the two classes of compounds, i.e. the N,N' dimers of the phenothiazine component and the alkylphenols are different, compounds which have the desired boiling point can be easily selected from each class. In some cases it may be desirable to use lower boiling antifoulants in combination with the antifoulant system of the invention. This can advantageously provide protection to the overhead portion of the column. It may also be desirable to add with the antifoulant system of the invention other agents, such as corrosion inhibitors, to provide additional protection to process equipment.

The antifoulant system of the invention can be introduced into the monomer to be protected by any conventional method. They are generally introduced just upstream of the point of desired application by any suitable means, such as by the use of a proportionating pump. It can be added to the feedstream as a single composition containing all of the desired antifoulant compounds, or the individual components can be added separately or in any other desired combination. The composition may be added as a concentrate, if desired, but it is preferable to add it as a solution which is compatible with the monomer being treated. Suitable solvents include kerosene, naphtha, the lower alkanes such as hexane, aromatic solvents, such as toluene, alcohols, ketones, etc. The concentration of antifoulant system in the solvent is desirably in the range of about 1 to 30 weight percent and preferably about 5 to 20 weight percent based on the total weight of antifoulant and solvent.

The antifoulant is used at a concentration which is effective to provide the desired protection against hydrocarbon fouling. It has been determined that amounts of antifoulant in the range of about 0.5 to 1000 ppm based on the weight of the hydrocarbon feedstream being processed afford ample protection against undesired fouling. For most applications the inhibitor system is used in amounts in the range of about 1 to 500 ppm.

The following examples will serve to further illustrate the invention. Unless otherwise stated, parts and percentages are on a weight basis. In the examples the thermal fouling determinations were made using a Jet Fuel Thermal Oxidation Tester marketed by Alcor, Inc. The specifications of this apparatus are set forth in ASTM D3241-74T. In general the apparatus consists of a reservoir to hold the hydrocarbon liquid being tested, an electrically heated tubular heater and a precision stainless steel filter. Tubular conduit connects the reservoir with the heater and the heater with the filter. Pressure gauges are provided for measuring the pressure drop across the filter. A thermocouple and a temperature controller are provided for precise control of the temperature of the liquid passing through the heater.

In operation, a hydrocarbon oil is pumped through the heater, which has adequate heat transfer surface to maintain the heater effluent at a predetermined temperature in the range of about 250° to 900° F. As the hydrocarbon passes through the heater a film of polymeric residue builds up on the inside of the heater. Particles of the residue slough off the surface of the heater tube and are caught in the filter. As the filter clogs up the pressure drop across the filter increases. The fouling rate in the heater is approximated by measuring the rate of pressure build-up across the filter. The equipment is dismantled and thoroughly cleaned after each run.

In the following examples antifoulant effectiveness is measured by comparing the time required for the pressure drop of a hydrocarbon stream containing the antifoulant to reach a certain value with the time required for the pressure drop of a stream of the same hydrocarbon but without the antifoulant to reach the same pressure drop value. The hydrocarbon stream used in the examples was the bottoms product obtained from a toluene recovery unit. This product consists primarily of light hydrocarbons, i.e. up to about 8 carbon atoms and is substantially free of non-aromatic hydrocarbons. This feedstock was selected because aromatic streams usually contain higher unsaturated materials which cause fouling in the recovery tower and associated heat exchangers.

EXAMPLE

A series of antifoulant effectiveness tests were conducted using crude toluene as the solvent for the antifoulant. The tests were carried out using a hydrocarbon flow rate through the heater of about 240 ml per hour with the heater effluent temperature maintained at 600° F. The tests were terminated after 150 minutes. Run 1 was carried out using uninhibited hydrocarbon; Runs 2, 3 and 4 were carried out using the same hydrocarbon as was used in Run 1 but modified by the addition of 50 ppm of 10,10'-diphenothiazine, 50 ppm of p-t-butyl phenol and 50 ppm of a 50/50 mixture of 10,10'-diphenothiazine and p-t-butyl phenol respectively. The results are tabulated in the following table.

TABLE

| | Pressure Drop Across Filter, mm. Hg. | | | |
|---|---|---|---|---|
| Test Time (Minutes) | Run 1 (Blank) | Run 2 10,10'di-phenothiazine | Run 3 p-t-butyl phenol | Run 4 10,10'-diphenothiazine/ p-t-butyl phenol |
| 0 | 0 | 0 | 0 | 0 |
| 20 | — | — | 0 | — |
| 30 | 0 | 0 | 1 | — |
| 45 | 2 | 2 | 2.5 | — |
| 60 | 29 | 2 | 5 | 0 |
| 90 | 52 | — | — | — |
| 110 | 74 | 5 | — | 0.5 |
| 120 | 86 | — | 10 | — |
| 130 | 104 | 14 | — | 0.5 |
| 140 | 128 | 16 | 12.5 | 1.0 |
| 150 | 164 | 22 | 15 | 1.0 |

The foregoing example illustrates the benefits derived by the use of the antifoulant composition of the invention. In the control (Run 1) the fouling rate was excessive, as shown by the pressure drop after 150 minutes. In Runs 2 and 3 (comparative) in which 10,10'-diphenothiazine and p-t-butyl phenol were used alone as the antifoulant pressure drops of 22 and 15 resulted after 150 minutes. The result obtained in Run 4, in which the antifoulant system of the invention was used, was far superior to the result obtained in the prior runs.

Although the invention is described with particular reference to specific examples, it is understood that the invention includes obvious variants. For example, the antifoulant system can be formulated to contain more than one dimer derivative of phenothiazine. The scope of the invention is limited only by the breadth of the claims.

What is claimed is:

1. In a method of inhibiting fouling of hydrocarbon processing equipment during the processing of hydrocarbons at elevated temperatures comprising introducing into the equipment an amount of an antifoulant agent effective to substantially reduce the rate of fouling, the improvement comprising using as the agent a combination of:

(1) at least one dimer selected from the N,N' dimers of phenothiazine, halo-substituted phenothiazine, alkyl-substituted phenothiazine and haloalkyl-substituted phenothiazines, and (2) at least one alkylphenol.

2. In a method of inhibiting fouling of hydrocarbon processing equipment during the processing of hydrocarbons at elevated temperatures comprising introducing into the equipment an antifoulant agent effective to substantially reduce the rate of fouling, the improvement comprising using as the agent a combination of:

(1) at least one compound having the structural formula

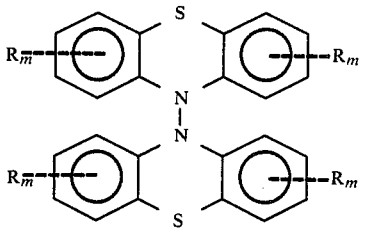

wherein the R's may be the same substituent or different substituents selected from alkyl groups having 1 to 20 carbon atoms, halogen atoms, halogen-substituted alkyl groups having 1 to 20 carbon atoms and mixtures of these and the m's may be the same integer or different integers in the range of 0 to 4, and (2) at least one compound having the structural formula

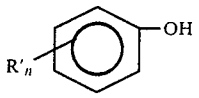

wherein R' is an alkyl group having a total of 1 to 20 carbon atoms and n is an integer having a value of 1 or 2.

3. The process of claim 2 wherein the total concentration of the compounds in (1) and (2) added to said hydrocarbon processing equipment is 0.5 to 1000 ppm, based on the total weight of hydrocarbon being processed in the equipment and the relative concentration of the compounds in (1) and (2) are 90 to 10 parts by weight and 10 to 90 parts by weight respectively.

4. The process of claim 2 wherein the m is an integer selected from 0, 1 and 2, each R is an alkyl group having 1 to 6 carbon atoms, R' is the tertiary alkyl group having 4 to 8 carbon atoms, the relative concentrations of the compounds in (1) and (2) are 25 to 75 parts by weight and 75 to 25 parts by weight respectively and the total concentration of the compounds in (1) and (2) in said hydrocarbon processing equipment is 1 to 500 ppm, based on the total weight of hydrocarbon being processed.

5. The process of claim 1 wherein the compound in (1) is 10,10'-diphenothiazine and the compound in (2) is selected from tertiary butylphenol, ditertiary butylphenols, and mixtures of these.

* * * * *